US009505228B2

(12) United States Patent
Mochizuki et al.

(10) Patent No.: US 9,505,228 B2
(45) Date of Patent: Nov. 29, 2016

(54) INK JET RECORDING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Yoshiaki Mochizuki, Shizuoka-ken (JP); Keiichi Kikuchi, Kanagawa-ken (JP); Kahori Nishikawa, Shiga-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/984,012

(22) Filed: Dec. 30, 2015

(65) Prior Publication Data

US 2016/0107451 A1 Apr. 21, 2016

Related U.S. Application Data

(63) Continuation of application No. 14/011,927, filed on Aug. 28, 2013, now abandoned.

(30) Foreign Application Priority Data

Sep. 7, 2012 (JP) ..... 2012-197715

(51) Int. Cl.
*B41J 2/175* (2006.01)
*B41J 2/18* (2006.01)

(52) U.S. Cl.
CPC .. *B41J 2/18* (2013.01); *B41J 2/175* (2013.01)

(58) Field of Classification Search
CPC ..... B41J 2/175; B41J 2/18
USPC ..... 347/68, 86, 89
See application file for complete search history.

(56) References Cited

U.S. PATENT DOCUMENTS 4,680,696 A * 7/1987 Ebinuma ..... B41J 2/175 346/139 R
4,835,554 A * 5/1989 Hoisington ..... B41J 2/155 347/40

(Continued)

FOREIGN PATENT DOCUMENTS

| | | |
|---|---|---|
| JP | 2006-283005 | 10/2006 |
| JP | 2007-197658 | 8/2007 |
| JP | 2007-302798 | 11/2007 |
| JP | 2007-314749 | 12/2007 |
| JP | 2008-162262 | 7/2008 |

(Continued)

OTHER PUBLICATIONS

First Office Action for Japanese Patent Application No. 2012-197715 dated Jun. 23, 2015, 9 pages.

(Continued)

*Primary Examiner* — Stephen Meier
*Assistant Examiner* — Alexander D Shenderov
(74) *Attorney, Agent, or Firm* — Amin, Turocy & Watson LLP; Gregory Turocy

(57) ABSTRACT

An ink jet recording apparatus according to one exemplary embodiment includes an actuator, a nozzle plate, a supply unit, a discharging unit, and a circulating unit. The actuator includes a pressure chamber which accommodates ink, and changes volume of the pressure chamber. The nozzle plate opens to the pressure chamber and includes a nozzle having a diameter of 20 μm to 40 μm. The supply unit supplies the ink to the pressure chamber. The discharging unit collects the ink from the pressure chamber. The circulating unit circulates the ink in the supply unit, the pressure chamber, and the discharging unit. In the ink, an average particle size in laser diffraction type particle distribution measurement is from 0.4 μm to 6.5 μm, the average particle size is substantially the same as a particle size in 50% integrated value, and a particle size in 90% integrated value is double or less the particle size in 50% integrated value.

14 Claims, 8 Drawing Sheets

(56) References Cited

U.S. PATENT DOCUMENTS

| | | | | |
|---|---|---|---|---|
| 6,554,411 | B1 * | 4/2003 | Hatasa | B41J 2/17503 347/86 |
| 7,128,404 | B2 | 10/2006 | Kodama | |
| 2007/0078200 | A1 | 4/2007 | Yoshida et al. | |
| 2007/0144399 | A1 | 6/2007 | Nagashima et al. | |
| 2008/0158307 | A1 | 7/2008 | Nitta et al. | |
| 2008/0250970 | A1 | 10/2008 | Oyanagi et al. | |
| 2009/0015640 | A1 | 1/2009 | Nishida et al. | |
| 2009/0270239 | A1 | 10/2009 | Katsuyama et al. | |
| 2011/0014440 | A1 * | 1/2011 | Itano | C09D 11/322 428/207 |
| 2011/0074865 | A1 | 3/2011 | Hasegawa et al. | |
| 2011/0115847 | A1 | 5/2011 | Hayashi et al. | |
| 2011/0273512 | A1 | 11/2011 | Murase et al. | |
| 2012/0223998 | A1 | 9/2012 | Kagata | |

FOREIGN PATENT DOCUMENTS

| | | |
|---|---|---|
| JP | 2009-280749 | 12/2009 |
| JP | 2012-061768 | 3/2012 |
| WO | 2006-106623 | 10/2006 |

OTHER PUBLICATIONS

Non-Final Office Action for U.S. Appl. No. 14/011,927 dated Sep. 17, 2014, 16 pages.

Final Office Action for U.S. Appl. No. 14/011,927 dated Jan. 16, 2015, 9 pages.

Non-Final Office Action for U.S. Appl. No. 14/011,927 dated May 20, 2015, 17 pages.

Final Office Action for U.S. Appl. No. 14/011,927 dated Oct. 2, 2015, 17 pages.

* cited by examiner

| REFRACTIVE INDEX = 3.20-0.00i | MEDIAN DIAMETER: 0.995<br>MODE DIAMETER: 1.122 | AVERAGE VALUE: 1.009<br>STANDARD DEVIATION: 0.206 |
|---|---|---|

| | INTEGRATED VALUE Q(%) | PARTICLE SIZE X(μm) | | INTEGRATED VALUE Q(%) | PARTICLE SIZE X(μm) | | INTEGRATED VALUE Q(%) | PARTICLE SIZE X(μm) |
|---|---|---|---|---|---|---|---|---|
| 1 | 98.000 | 2.834 | 18 | 64.000 | 1.195 | 35 | 30.000 | 0.756 |
| 2 | 96.000 | 2.424 | 19 | 62.000 | 1.164 | 36 | 28.000 | 0.733 |
| 3 | 94.000 | 2.213 | 20 | 60.000 | 1.134 | 37 | 26.000 | 0.711 |
| 4 | 92.000 | 2.020 | 21 | 58.000 | 1.105 | 38 | 24.000 | 0.689 |
| 5 | 90.000 | 1.912 | 22 | 56.000 | 1.076 | 39 | 22.000 | 0.668 |
| 6 | 88.000 | 1.819 | 23 | 54.000 | 1.048 | 40 | 20.000 | 0.647 |
| 7 | 86.000 | 1.731 | 24 | 52.000 | 1.021 | 41 | 18.000 | 0.626 |
| 8 | 84.000 | 1.648 | 25 | 50.000 | 0.995 | 42 | 16.000 | 0.603 |
| 9 | 82.000 | 1.574 | 26 | 48.000 | 0.969 | 43 | 14.000 | 0.580 |
| 10 | 80.000 | 1.524 | 27 | 46.000 | 0.943 | 44 | 12.000 | 0.558 |
| 11 | 78.000 | 1.477 | 28 | 44.000 | 0.918 | 45 | 10.000 | 0.537 |
| 12 | 76.000 | 1.430 | 29 | 42.000 | 0.894 | 46 | 8.000 | 0.517 |
| 13 | 74.000 | 1.385 | 30 | 40.000 | 0.871 | 47 | 6.000 | 0.495 |
| 14 | 72.000 | 1.342 | 31 | 38.000 | 0.848 | 48 | 4.000 | 0.460 |
| 15 | 70.000 | 1.300 | 32 | 36.000 | 0.825 | 19 | 2.000 | 0.428 |
| 16 | 68.000 | 1.259 | 33 | 34.000 | 0.804 | 50 | | |
| 17 | 66.000 | 1.226 | 34 | 32.000 | 0.780 | 51 | | |

| REFRACTIVE INDEX = 3.20-0.00i | MEDIAN DIAMETER: 0.582<br>MODE DIAMETER: 0.562 | AVERAGE VALUE: 0.596<br>STANDARD DEVIATION: 0.196 |
|---|---|---|

| | INTEGRATED VALUE Q(%) | PARTICLE SIZE X(μm) | | INTEGRATED VALUE Q(%) | PARTICLE SIZE X(μm) | | INTEGRATED VALUE Q(%) | PARTICLE SIZE X(μm) |
|---|---|---|---|---|---|---|---|---|
| 1 | 98.000 | 1.555 | 18 | 64.000 | 0.699 | 35 | 30.000 | 0.451 |
| 2 | 96.000 | 1.383 | 19 | 62.000 | 0.681 | 36 | 28.000 | 0.439 |
| 3 | 94.000 | 1.245 | 20 | 60.000 | 0.662 | 37 | 26.000 | 0.428 |
| 4 | 92.000 | 1.177 | 21 | 58.000 | 0.644 | 38 | 24.000 | 0.416 |
| 5 | 90.000 | 1.113 | 22 | 56.000 | 0.627 | 39 | 22.000 | 0.406 |
| 6 | 88.000 | 1.052 | 23 | 54.000 | 0.612 | 40 | 20.000 | 0.394 |
| 7 | 86.000 | 0.997 | 24 | 52.000 | 0.597 | 41 | 18.000 | 0.381 |
| 8 | 84.000 | 0.962 | 25 | 50.000 | 0.582 | 42 | 16.000 | 0.368 |
| 9 | 82.000 | 0.928 | 26 | 48.000 | 0.568 | 43 | 14.000 | 0.355 |
| 10 | 80.000 | 0.896 | 27 | 46.000 | 0.554 | 44 | 12.000 | 0.343 |
| 11 | 78.000 | 0.864 | 28 | 44.000 | 0.540 | 45 | 10.000 | 0.331 |
| 12 | 76.000 | 0.834 | 29 | 42.000 | 0.527 | 46 | 8.000 | 0.320 |
| 13 | 74.000 | 0.805 | 30 | 40.000 | 0.514 | 47 | 6.000 | 0.302 |
| 14 | 72.000 | 0.781 | 31 | 38.000 | 0.501 | 48 | 4.000 | 0.282 |
| 15 | 70.000 | 0.760 | 32 | 36.000 | 0.488 | 19 | 2.000 | 0.263 |
| 16 | 68.000 | 0.739 | 33 | 34.000 | 0.475 | 50 | | |
| 17 | 66.000 | 0.719 | 34 | 32.000 | 0.463 | 51 | | |

| REFRACTIVE INDEX = 3.00-0.20i | MEDIAN DIAMETER: 1.563<br>MODE DIAMETER: 1.413 | AVERAGE VALUE: 1.600<br>STANDARD DEVIATION: 0.174 |
|---|---|---|

| | INTEGRATED VALUE Q(%) | PARTICLE SIZE X(μm) | | INTEGRATED VALUE Q(%) | PARTICLE SIZE X(μm) | | INTEGRATED VALUE Q(%) | PARTICLE SIZE X(μm) |
|---|---|---|---|---|---|---|---|---|
| 1 | 98.000 | 3.822 | 18 | 64.000 | 1.840 | 35 | 30.000 | 1.255 |
| 2 | 96.000 | 3.396 | 19 | 62.000 | 1.797 | 36 | 28.000 | 1.223 |
| 3 | 94.000 | 3.098 | 20 | 60.000 | 1.756 | 37 | 26.000 | 1.192 |
| 4 | 92.000 | 2.941 | 21 | 58.000 | 1.715 | 38 | 24.000 | 1.162 |
| 5 | 90.000 | 2.792 | 22 | 56.000 | 1.675 | 39 | 22.000 | 1.132 |
| 6 | 88.000 | 2.650 | 23 | 54.000 | 1.637 | 40 | 20.000 | 1.104 |
| 7 | 86.000 | 2.516 | 24 | 52.000 | 1.599 | 41 | 18.000 | 1.076 |
| 8 | 84.000 | 2.438 | 25 | 50.000 | 1.563 | 42 | 16.000 | 1.049 |
| 9 | 82.000 | 2.364 | 26 | 48.000 | 1.529 | 43 | 14.000 | 1.022 |
| 10 | 80.000 | 2.293 | 27 | 46.000 | 1.496 | 44 | 12.000 | 0.993 |
| 11 | 78.000 | 2.224 | 28 | 44.000 | 1.464 | 45 | 10.000 | 0.951 |
| 12 | 76.000 | 2.156 | 29 | 42.000 | 1.432 | 46 | 8.000 | 0.911 |
| 13 | 74.000 | 2.091 | 30 | 40.000 | 1.401 | 47 | 6.000 | 0.872 |
| 14 | 72.000 | 2.028 | 31 | 38.000 | 1.371 | 48 | 4.000 | 0.835 |
| 15 | 70.000 | 1.973 | 32 | 36.000 | 1.341 | 19 | 2.000 | 0.799 |
| 16 | 68.000 | 1.928 | 33 | 34.000 | 1.312 | 50 | | |
| 17 | 66.000 | 1.883 | 34 | 32.000 | 1.283 | 51 | | |

INK JET RECORDING APPARATUS

CROSS-REFERENCE TO RELATED APPLICATIONS

This application is a Continuation of application Ser. No. 14/011,927 filed Aug. 28, 2013, the entire contents of which are incorporated herein by reference.

This application is based upon and claims the benefit of priority from Japanese Patent Application No. 2012-197715, filed Sep. 7, 2012, the entire contents of which are incorporated herein by reference.

FIELD

Embodiments described herein relate generally to an ink jet recording apparatus and a recording method.

BACKGROUND

There are various known ink jet head, such as a piezoelectric type, used for an inkjet recording apparatus. As an ink jet head of the piezoelectric type, a so-called end-shooter type and a side-shooter type are known.

Dust or dirt may enter an ink chamber to which ink is supplied, from nozzles of the ink jet head. In addition, bubbles, foreign materials, and coarse particles may be mixed in the ink. As a result of the above, printing omission may occur in the ink jet head.

In the ink jet head of the end-shooter type, ink does not circulate. Accordingly, multiple maintenances are performed in the ink jet head of the end-shooter type, in order to remove bubbles and the like and recover the function thereof.

On the other hand, ink circulates in the ink jet head of the side-shooter type. Accordingly, dust or bubbles are discharged from the inside of the inkjet head and nozzle clogging is suppressed.

Various types of ink are used for purposes thereof, in an ink jet recording apparatus. However, if ink having a large pigment particle size is used, for example, printing omission may occur even when the bubbles and the like are not mixed.

DETAILED DESCRIPTION

In accordance with an embodiment, an ink jet recording apparatus according to one exemplary embodiment includes an actuator, a nozzle plate, a supply unit, a discharging unit, and a circulating unit. The actuator includes a pressure chamber which accommodates ink, and changes volume of the pressure chamber. The nozzle plate opens to the pressure chamber and includes a nozzle having a diameter of 20 μm to 40 μm. The supply unit supplies the ink to the pressure chamber. The discharging unit collects the ink from the pressure chamber. The circulating unit circulates the ink in the supply unit, the pressure chamber, and the discharging unit. In the ink, an average particle size in laser diffraction type particle distribution measurement is from 0.4 μm to 6.5 μm, the average particle size is substantially the same as a particle size in 50% integrated value, and a particle size in 90% integrated value is double or less the particle size in 50% integrated value.

Hereinafter, one exemplary embodiment will be described with reference to FIGS. 1 to 8. One or more examples of expressions may be used for each element which can have a plurality of expressions, and this does not mean that elements with no other expressions is denied to have a different expression, and the other expressions which are not exemplified, are not limited.

Figure 1:
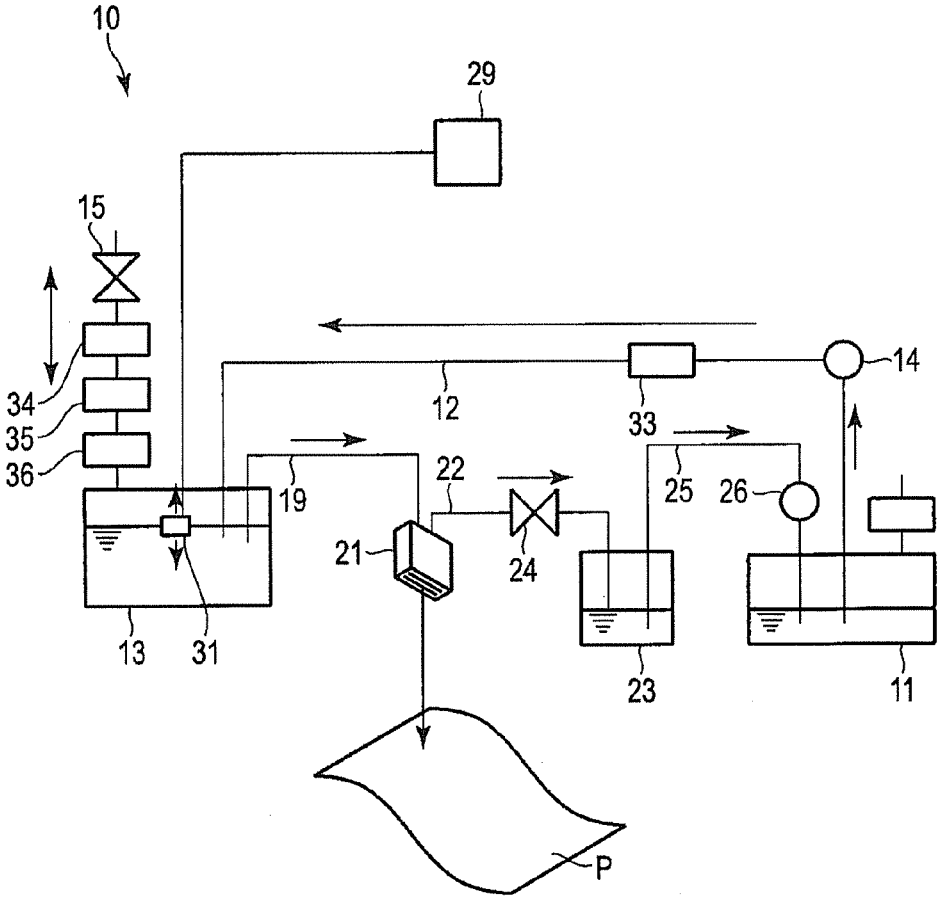
FIG. 1 is a schematic view showing an ink jet printer according to an exemplary embodiment.

FIG. 1 is a schematic view showing an ink jet printer 10 of one exemplary embodiment. The ink jet printer 10 is an example of the ink jet recording apparatus. As shown in FIG. 1, the ink jet printer 10 includes a first tank 11, a first flow path 12, a second tank 13, a first pump 14, an air valve 15, a second flow path 19, an ink jet head 21, a third flow path 22, a third tank 23, a valve 24, a fourth flow path 25, a second pump 26, and a control unit 29.

The first tank 11 is an example of an ink tank. The first flow path 12, the second tank 13, and the second flow path 19 are examples of ink supply paths. The third flow path 22, the third tank 23, and the fourth flow path 25 are examples of ink collecting paths. The first pump 14, the air valve 15, the valve 24, the second pump 26, and the control unit 29 are examples of circulating units.

The first tank 11 accommodates ink. The first tank 11 is detachable from the ink jet printer 10. When ink accommodated in the first tank 11 runs out, the empty first tank 11 is replaced with a new first tank 11 by a user.

The first flow path 12 is connected to the first tank 11. The first flow path 12 is a pipe through which the ink passes, for example. One end portion of the first flow path 12 is dipped in the ink accommodated in the first tank 11.

The second tank 13 accommodates ink. The other end portion of the first flow path 12 is connected to the second tank 13. The second tank 13 is connected to the first tank 11 through the first flow path 12.

A sensor 31 is disposed in the second tank 13. The sensor 31 is a float sensor, for example. The sensor 31 floats on the ink accommodated in the second tank 13. The sensor 31 is turned on when the level of the ink accommodated in the second tank 13 is lower than a predetermined height, and is turned off when the level of the ink is higher than the predetermined height. That is, the sensor 31 detects increase and decrease of the ink accommodated in the second tank 13.

The first pump 14 is disposed in the middle of the first flow path 12. The first pump 14 transports the ink accommodated in the first tank 11 to the second tank 13. The first pump 14 is operated and stopped by the control unit 29.

An ink filter 33 is disposed in the middle of the first flow path 12. The ink filter 33 removes dust or dirt from the ink transported to the second tank 13 from the first tank 11 through the first flow path 12.

The air valve 15 is connected to the second tank 13. When the air valve 15 is opened, the second tank 13 is exposed to the air. When the air valve 15 is closed, the second tank 13 is shielded from the air. The air valve 15 is opened and closed by the control unit 29.

An over-flow catch 34, an air filter 35, and an over-flow sensor 36 are interposed between the air valve 15 and the second tank 13. The over-flow catch 34 stops the increasing ink. The air filter 35 removes dust or dirt from the air entering the second tank 13 through the air valve 15. The over-flow sensor 36 detects the increasing ink.

The second flow path 19 is connected to the second tank 13. The second flow path 19 is a pipe through which ink passes, for example. One end portion of the second flow path 19 is dipped in the ink accommodated in the second tank 13. As described above, the first flow path 12, the second tank 13, and the second flow path 19 are connected to the first tank 11.

The third flow path 22 is connected to the ink jet head 21. The third flow path 22 is a pipe through which ink passes, for example.

The third tank 23 accommodates ink. The third flow path 22 is connected to the third tank 23. The third tank 23 is connected to the ink jet head 21 through the third flow path 22.

Figure 2:
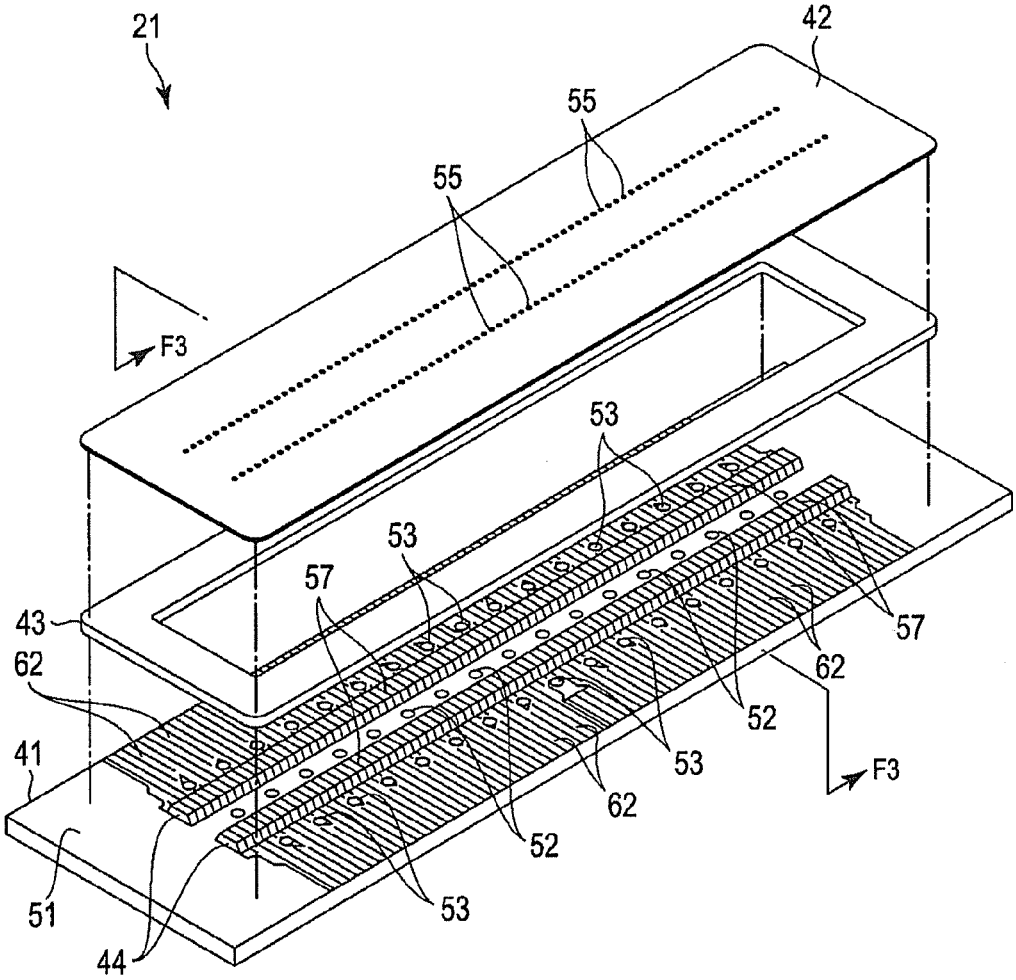
FIG. 2 is a perspective view showing an exploded part of an ink jet head of the exemplary embodiment.
Figure 3:
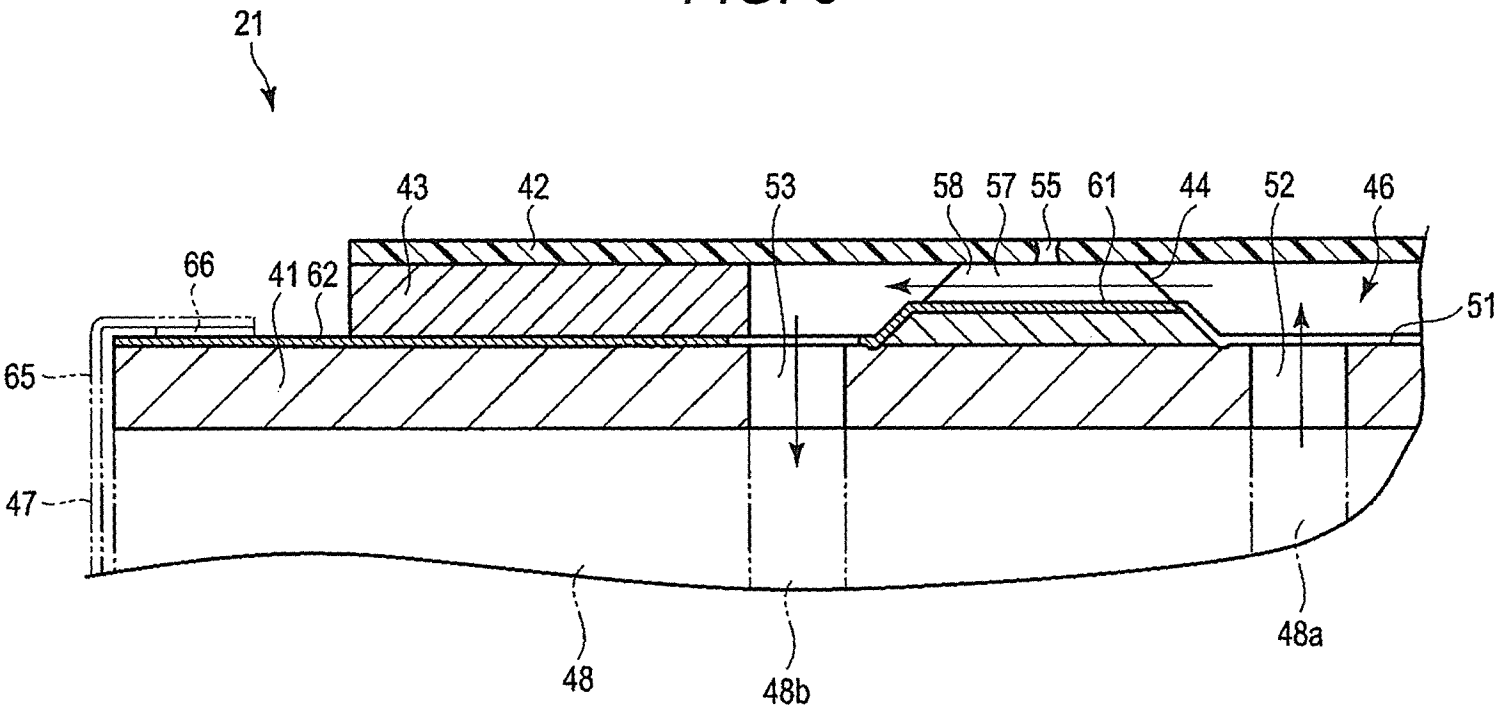
FIG. 3 is a cross-sectional view of a part of an ink jet head of the exemplary embodiment, taken along line F3-F3 of FIG. 2.

FIG. 2 is a perspective view showing an exploded part of the ink jet head 21. FIG. 3 is a cross-sectional view showing a part of the ink jet head 21 along line F3-F3 of FIG. 2. As shown in FIG. 2, the ink jet head 21 is an ink jet head of a so-called side-shooter type in a share mode and share wall system. The ink jet head 21 is a device for discharging the ink and is mounted inside of the ink jet printer 10.

The ink jet head 21 includes a base plate 41, a nozzle plate 42, a frame member 43, and a pair of actuators 44. As shown in FIG. 3, an ink chamber 46 to which the ink is supplied, is formed in the ink jet head 21.

In addition, as shown in FIG. 3 by dashed-two-dotted lines, various components such as a circuit board 47 for controlling the ink jet head 21 or a manifold 48 which forms a part of a flow path between the ink jet head 21 and the second tank 13, are attached to the ink jet head 21.

As shown in FIG. 2, the base plate 41 is formed in a rectangular plate shape with ceramics such as alumina, for example. The base plate 41 includes a flat mounting surface 51. A plurality of supply holes 52 and a plurality of discharging holes 53 are provided on the mounting surface 51.

The supply holes 52 are provided in a line in a longitudinal direction of the base plate 41, in the center of the base plate 41. As shown in FIG. 3, the supply hole 52 communicates with an ink supply unit 48*a* of the manifold 48 connected to the second flow path 19.

The supply hole 52 is connected to the second flow path 19 through the ink supply unit 48*a*. The ink jet head 21 is connected to the second tank 13 through the second flow path 19. That is, the ink jet head 21 is connected to the first tank 11 through the ink supply unit 48*a* of the manifold 48, the second flow path 19, the second tank 13, and the first flow path 12.

As shown in FIG. 3 by arrows, the ink of the second tank 13 is supplied to the ink chamber 46 from the supply hole 52, through the second flow path 19 and the ink supply unit 48*a* of the manifold 48. The first tank 11, the first flow path 12, the second tank 13, the second flow path 19, the ink supply unit 48*a* of the manifold 48, and the supply hole 52 are examples of the supply unit.

As shown in FIG. 2, a discharging hole 53 is provided in two lines so as to interpose the supply hole 52. As shown in FIG. 3, the discharging hole 53 communicates with an ink discharging unit 48*b* of the manifold 48 connected to the third flow path 22. The discharging hole 53, the ink discharging unit 48*b* of the manifold 48, the third flow path 22, the third tank 23, and the fourth flow path 25 are examples of the discharging unit.

The discharging hole 53 is connected to the third flow path 22 through the ink discharging unit 48*b*. As shown in FIG. 3 by arrows, the ink in the ink chamber 46 is discharged to the third tank 23 from the discharging hole 53, through the ink discharging unit 48*b* of the manifold 48 and the third flow path 22.

As shown in FIG. 2, the nozzle plate 42 is formed by a rectangular film made of polyimide, for example. In addition, the nozzle plate 42 may be formed by the other material such as stainless steel. The nozzle plate 42 opposes the mounting surface 51 of the base plate 41.

A plurality of nozzles 55 are provided on the nozzle plate 42. The number of the nozzles of the exemplary embodiment is 636. A plurality of nozzles 55 are arranged in two lines along a longitudinal direction of the nozzle plate 42. The nozzle 55 opposes the portion between the supply hole 52 and the discharging hole 53 of the mounting surface 51. The diameter of the nozzle 55 is 24 μm. In addition, the diameter of the nozzle 55 is not limited thereto, and may be from 20 μm to 40 μm.

The frame member 43 is formed in a rectangular frame shape by a nickel alloy, for example. The frame member 43 is interposed between the mounting surface 51 of the base plate 41 and the nozzle plate 42. The frame member 43 is adhered to each of the mounting surface 51 and the nozzle plate 42. That is, the nozzle plate 42 is attached to the base plate 41 through the frame member 43.

As shown in FIG. 3, the ink chamber 46 is formed to be surrounded by the base plate 41, the nozzle plate 42, and the frame member 43. The ink chamber 46 is formed between the base plate 41 and the nozzle plate 42.

The pair of actuators 44 is formed by plate-shaped two piezoelectric bodies formed by lead zirconate titanate (PZT), for example. The two piezoelectric bodies are bonded to each other so that their polarization directions are oriented opposite to each other along the thickness direction.

The pair of actuators 44 is adhered to the mounting surface 51 of the base plate 41. The actuator 44 is adhered to the mounting surface 51 by an epoxy-based adhesive having a thermosetting property, for example. As shown in FIG. 2, the actuator 44 is disposed in parallel in the ink chamber 46, corresponding to the nozzles 55 arranged in two lines. The actuators 44 are formed in a cross-sectional trapezoid shape. The top of the actuator 44 is adhered to the nozzle plate 42.

As shown in FIG. 3, a plurality of pressure chambers 57 are provided in the actuator 44. The pressure chambers 57 are grooves formed in the actuator 44. The actuator 44 includes a plurality of side walls 58 where the pressure chambers 57 are formed. The pressure chambers 57 are respectively extended in a direction intersecting the longitudinal direction of the actuator 44, and are arranged in a longitudinal direction of the actuator 44.

The plurality of nozzles 55 of the nozzle plate 42 are opened to the plurality of pressure chambers 57. As shown in FIG. 3, the pressure chambers 57 are opened to the ink chamber 46. Accordingly, as shown in FIG. 3 by arrows, the ink passes through the pressure chambers 57 of the actuators 44. That is, the ink supplied from the supply holes 52 to the ink chamber 46 is discharged from the discharging hole 53 through the pressure chambers 57 of the actuators 44.

Electrodes 61 are provided in each pressure chamber 57. The electrode 61 is formed by thin nickel film, for example. The electrode 61 covers the inner surface of the pressure chamber 57.

As shown in FIG. 2, a plurality of wiring patterns 62 are provided from the mounting surface 51 of the base plate 41 to the actuators 44. The wiring pattern 62 is formed by a thin nickel film, for example. Each of the wiring patterns 62 extends from the electrode 61 formed in the pressure chamber 57 of the actuator 44 to one of side end portions of the mounting surface 51.

As shown in FIG. 3, the circuit board 47 is a film carrier package (FCP), and includes a film 65 made by a resin in which a plurality of wirings are formed and which has flexibility, and an IC connected to the plurality of wirings of the film 65. In addition, the FCP is also called a tape carrier package (TCP).

The film 65 is a tape automatic bonding (TAB). The IC is a component for applying voltage to the electrode 61. The IC is fixed to the film 65 by a resin, for example.

The end portion of the film 65 is connected to the wiring patterns 62 by thermal compression bonding, by an anisotropic conductive film (ACF) 66. Accordingly, the plurality of wirings of the film 65 are electrically connected to the wiring patterns 62. By connecting the film 65 to the wiring patterns 62, the IC is electrically connected to the electrode 61 through the wirings of the film 65.

As shown in FIG. 1, the valve 24 is disposed in the middle of the third flow path 22. When the valve 24 is closed, the third flow path 22 is closed. When the valve 24 is opened, the third flow path 22 is opened. The valve 24 is opened and closed by the control unit 29.

The fourth flow path 25 connects the third tank 23 and the first tank 11. The fourth flow path 25 is a pipe through which the ink passes, for example. One end portion of the fourth flow path 25 is dipped in the ink accommodated in the third tank 23.

As described above, the ink jet head 21 is connected to the first tank 11 through the ink discharging unit 48*b* of the manifold 48, the third flow path 22, the third tank 23, and the fourth flow path 25.

The second pump 26 is disposed in the middle of the fourth flow path 25. The second pump 26 transports the ink accommodated in the third tank 23 to the first tank 11. The second pump 26 is operated and stopped by the control unit 29.

The control unit 29 shown in FIG. 1 functions by various electronic components such as an integrated circuit and memories, for example. The control unit 29 performs transmission of printing commands by operation of a user, for example. The printing command is information used for printing of an image based on the operation of a user, for example. In FIG. 1, the control unit 29 is connected only to the sensor 31, or the control unit 29 is connected to various elements. The control unit 29 controls the first pump 14, the air valve 15, the ink jet head 21, the valve 24, and the second pump 26, for example.

The ink jet printer 10 and the control unit 29 switches a stand-by state, a maintenance state, and a printing state, for example. In the stand-by state, the control unit 29 opens the valve 24 and operates the second pump 26. By operating the second pump 26, the ink accommodated in the third tank 23 is transported to the first tank 11. When voltage in the third tank 23 is decreased by transporting the ink, the ink accommodated in the second tank 13 is transported to the third tank 23 through the ink jet head 21. The ink passes through the pressure chamber 57 of the actuator 44, in the ink jet head 21.

By transporting the ink, the level of the ink accommodated in the second tank 13 is decreased. When the level of the ink of the second tank 13 is decreased to be lower than the predetermined height, the sensor 31 is turned on. When the sensor 31 is turned on, the control unit 29 operates the first pump 14. That is, the control unit 29 operates the first pump 14 when the sensor 31 detects that the ink of the second tank 13 is reduced more than the predetermined amount. By operating the first pump 14, the ink accommodated in the first tank 11 is transported to the second tank 13. When the level of the ink of the second tank 13 reaches the predetermined height by transporting the ink, the sensor 31 is turned off. When the sensor 31 is turned off, the control unit 29 stops the first pump 14.

As described above, the first pump 14, the air valve 15, the valve 24, the second pump 26, and the control unit 29 circulate the ink of the first tank 11, in the ink jet printer 10.

Hereinafter, the ink used in the ink jet printer 10 will be described. The ink used in the ink jet printer 10 (hereinafter, referred to as "used ink") contains aluminum pigments, for example. The used ink is not limited thereto, and may contain various other pigments.

Figure 4:
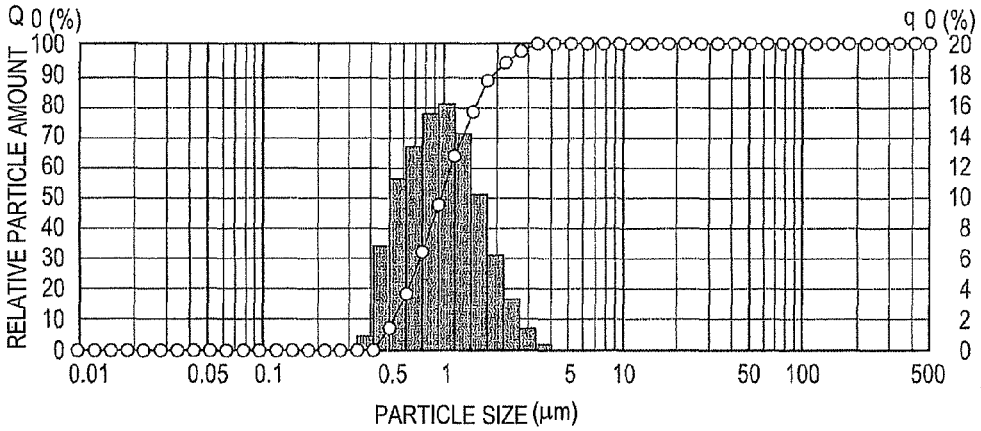
FIG. 4 is a table and a graph showing measurement results of First Example of used ink of the exemplary embodiment.
Figure 5:
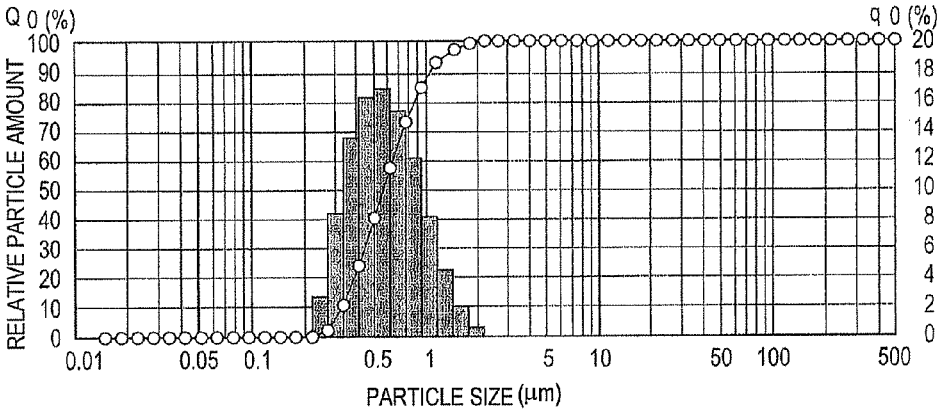
FIG. 5 is a table and a graph showing measurement results of Second Example of used ink of the exemplary embodiment.
Figure 6:
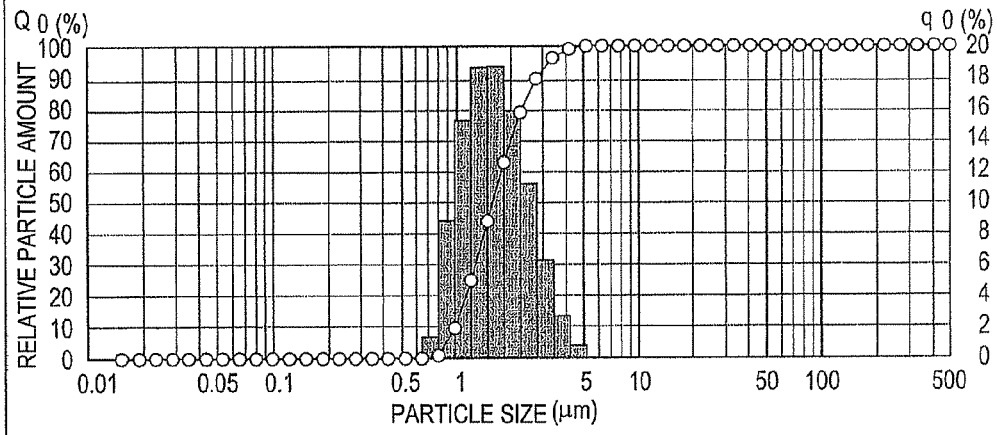
FIG. 6 is a table and a graph showing measurement results of Example of non-used ink of the exemplary embodiment.

FIG. 4 is a table and a graph showing measurement results of First Example of the used ink. FIG. 5 is a table and a graph showing measurement results of Second Example of the used ink. FIG. 6 is a table and a graph showing measurement results of Example of ink not used in the ink jet printer 10 (non-used ink). The measurement in FIG. 4 to FIG. 6 is performed by laser diffraction type particle distribution measurement. An "average particle size" which will be described later is an average particle size acquired by the laser diffraction type particle distribution measurement.

As shown in FIG. 4, in First Example of the used ink, an average particle size (average value) of the pigments is 1.009 [μm], and a particle size of the pigments in 50% integrated value is 0.995 [μm]. The particle size of the pigment in 50% integrated value means a size with the equivalent amounts in a larger side and a smaller side, when dividing the powder into two from a given particle size.

As shown in FIG. 5, in Second Example of the used ink, the average particle size (average value) of the pigments is 0.596 [μm], and the particle size of the pigment in 50% integrated value is 0.582 [μm].

As shown in FIG. 6, in Example of the non-used ink, the average particle size (average value) of the pigments is 1.600 [μm], and the particle size of the pigment in 50% integrated value is 1.563 [μm].

As described above, in First and Second Examples of the used ink and Example of the non-used ink, the average particle sizes of the pigments and the particle sizes in 50% integrated value are substantially the same. In First and Second Examples of the used ink and Example of the non-used ink, a difference between the particle size of the pigments in 50% integrated value and the average particle size of the pigments is within ±5%. The average particle size of the pigments in First and Second Examples of the used ink is from 0.4 [μm] to 1.3 [μm].

In First Example of the used ink, the particle size (1.912 [μm]) of the pigment in 90% integrated value is double or less the particle size (0.995 [μm]) of the pigment in 50% integrated value. In Second Example of the used ink, the particle size (1.113 [μm]) of the pigment in 90% integrated value is double or less the particle size (0.582 [μm]) of the pigment in 50% integrated value. In Example of the non-used ink, the particle size (2.792 [μm]) of the pigment in 90% integrated value is double or less the particle size (1.563 [μm]) of the pigment in 50% integrated value.

Standard deviation of the pigment of First Example of the used ink is 0.206, the standard deviation of the pigment of Second Example of the used ink is 0.196, and the standard deviation of the pigment of Example of the non-used ink is 0.174. That is, the standard deviation of the pigments of the First and Second Examples of the used ink and Example of the non-used ink is equal to or less than 0.21.

In First and Second Examples of the used ink and Example of the non-used ink, the particle size of the pigment in 50% integrated value is 0.01 to 0.325 times the diameter of the nozzle 55. That is, in the exemplary embodiment, the particle size of the pigment of First and Second Examples of the used ink and Example of the non-used ink in 50% integrated value is from 0.24 [μm] to 7.8 [μm].

The aluminum pigment is in a scale shape (rectangular plate shape), and includes a thickness, a particle short side, and a particle long side. That is, the shape of the aluminum pigment is non-spherical. The thickness is the shortest dimension among the pigment particles. The particle short side is shortest dimension among the pigment particles, in a direction intersecting the thickness. The particle long side is the longest dimension among the pigment particles in a direction intersecting the thickness. That is, in the ink containing spherical pigments, the particle size is always same when measured from any angle, and the average particle size and the average particle long side are the same.

In First and Second Example of the used ink and Example of the non-used ink, the thickness of the pigment is 20 [μm] to 100 [μm], and the particle short side is 0.5 [μm] to 3 [μm]. In First and Second Example of the used ink and Example of the non-used ink, the average particle long side is about 5 times the average particle size. That is, in First Example of the used ink, the average particle long side of the pigment is about 5 [μm], in Second Example of the used ink, the average particle long side of the pigment is about 3 [μm], and in Example of the non-used ink, the average particle long side of the pigment is about 8 [μm]. In addition, the average particle long side of the pigment of the used ink is not limited thereto and may be 1 to 5 times the average particle size of the pigments.

Hereinafter, an example of an image forming method of the ink jet printer 10 will be described. First, the ink jet printer 10 and the control unit 29 are turned into the stand-by state. The operations of the ink jet printer 10 and the control unit 29 in the stand-by state will be omitted since they are described above.

In the stand-by state, the control unit 29 waits for manipulation from a user, for example. By the manipulation of a user, for example, when the control unit 29 performs transmission of the printing command, the ink jet printer 10 passes the maintenance state and is turned into the printing state. In the maintenance state, the control unit 29 performs cleaning of the nozzle 55 of the ink jet head 21.

In the printing state, a printing medium P such as recording paper, for example, is disposed under the ink jet head 21. The ink jet head 21 changes the actuators 44 to a share mode based on the printing command transmitted by the control unit 29.

By being changed into the share mode, the actuators 44 increase and reduce the volume of the pressure chamber 57. Accordingly, the ink accommodated in the pressure chamber 57 is depressurized and pressurized, and is discharged from the nozzle 55. The ink which is not discharged and remains in the pressure chamber 57 is returned to the first tank 11 from the discharging hole 53.

The discharged ink is attached to the printing medium P. After the ink is discharged, the ink jet head 21 and the printing medium P are moved. The ink jet head 21 repeats discharging of the ink based on the printing command, and thus an image is formed on the printing medium P.

When an image is formed on the printing medium P based on the printing command, the printing state ends. When the printing state ends, the ink jet printer 10 and the control unit 29 are switched to the stand-by state. The ink jet printer 10 forms an image as described above.

Figure 7:
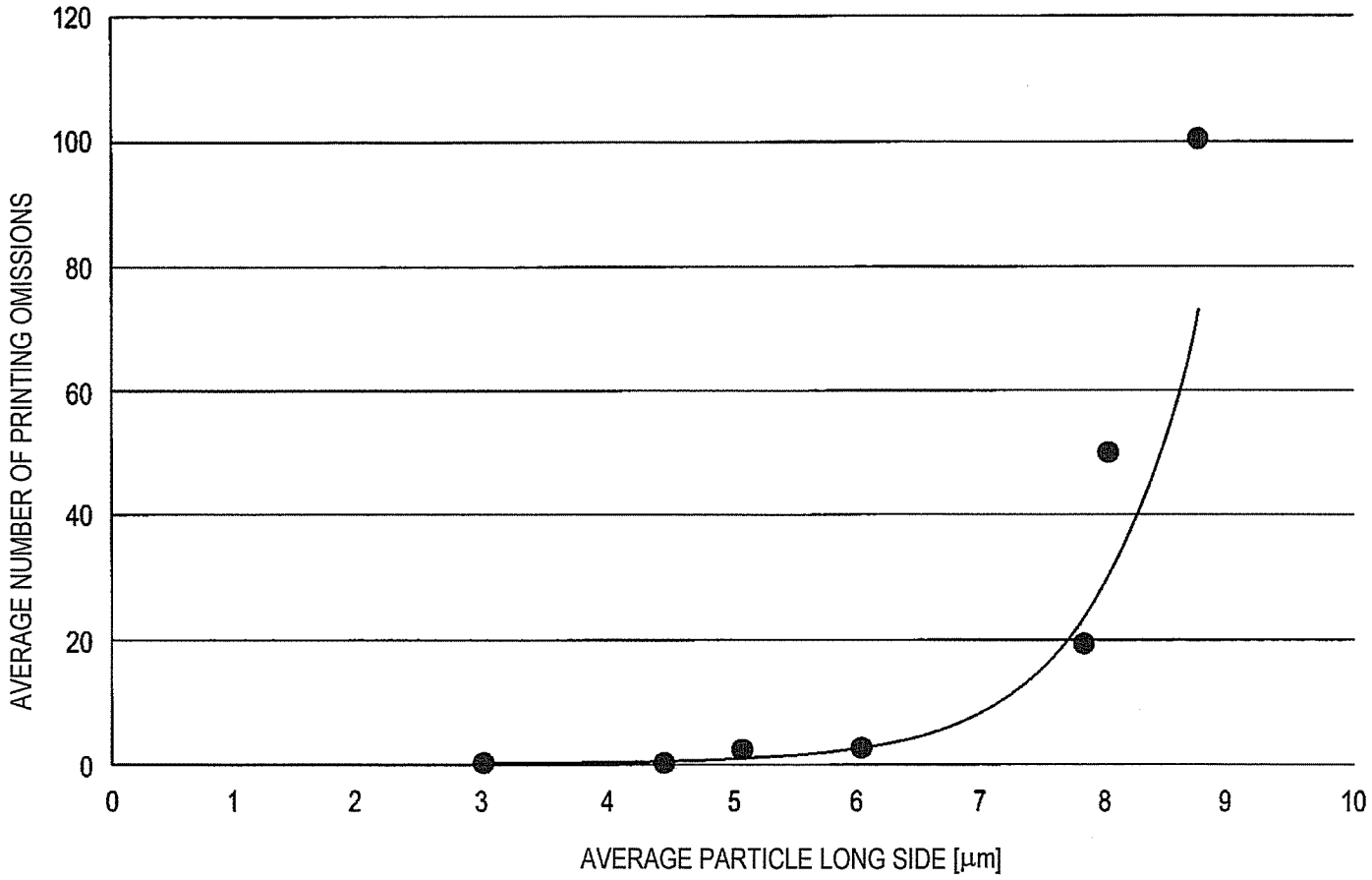
FIG. 7 is a graph showing a relationship between a long side of a particle of ink of the exemplary embodiment and printing omission.

FIG. 7 is a scatter diagram showing a relationship between the particle long side of the ink pigments and the printing omission. Table 1 shows the conditions of the ink pigments in an experiment of the scatter diagram of FIG. 7. In the experience of FIG. 7 and Table 1, the printing omission when plural levels of voltage are applied to the actuator 44 is measured and averaged. The plural levels of voltage are voltage in five levels such as voltage (predetermined voltage) for discharging the ink of 42 [pl], voltage obtained by adding ±2 [V] to the predetermined voltage, and voltage obtained by adding ±1 [V] to the predetermined voltage.

In FIG. 7 and Table 1, 90% particle size, 50% particle size, and 10% particle size represent particle size of pigments in 90% integrated value, 50% integrated value, and 10% integrated value, respectively. The dimension of the ink pigment of Table 1 is measured by the laser diffraction type particle distribution measurement.

In Table 1, the Ink No. 6 is First Example of the used ink shown in FIG. 4. The Ink No. 7 is Second Example of the used ink shown in FIG. 5. The Ink No. 8 is Example of the non-used ink shown in FIG. 6.

TABLE 1

| | Ink No. | | | | | | | | |
|---|---|---|---|---|---|---|---|---|---|
| | 1 | 3 | 4 | 5 | 6 | 7 | 8 | 9 | 10 |
| Viscosity (25° C.) | 6.0 | 6.6 | 6.2 | 6.2 | 7.2 | 6.6 | 6.7 | 23.0 | 6.5 |
| Average particle size [μm] | 1.211 | 0.886 | 0.886 | 0.886 | 1.009 | 0.596 | 1.600 | 1.749 | 1.560 |
| Average particle long side [μm] | 6.055 | 4.430 | 4.430 | 4.430 | 5.045 | 2.980 | 8.000 | 8.745 | 7.800 |
| 90% particle size [μm] | 2.214 | 1.655 | 1.655 | 1.655 | 1.912 | 1.113 | 2.792 | 3.123 | 2.824 |
| 50% particle size [μm] | 1.157 | 0.867 | 0.867 | 0.867 | 0.995 | 0.582 | 1.563 | 1.690 | 1.495 |
| 10% particle size [μm] | 0.710 | 0.485 | 0.485 | 0.485 | 0.537 | 0.331 | 0.951 | 1.032 | 0.937 |
| Ratio of 90% particle size/50% particle size | 1.9 | 1.9 | 1.9 | 1.9 | 1.9 | 1.9 | 1.8 | 1.8 | 1.8 |
| Average number of printing omissions | 2.4 | 0.2 | 0.2 | 0.8 | 2.4 | 0.2 | 50 | 100 | 19.2 |

As shown in Table 1, in the experience of FIG. 7 and Table 1, ratios of the 90% particle size and the 50% particle size of the ink of the Ink Nos. 1 to 10 are equal to or less than 2.0. In addition, the average particle sizes of the ink of the Ink Nos. 1 to 10 are substantially the same as the 50% particle size. As shown in FIG. 7 by an approximate curve L, when the average particle long side exceeds 6.5 [μm] (that is, when the average particle size exceeds 1.3 [μm]), the average number of the printing omissions is rapidly increased.

As described above, when the average particle size of the pigments of the used ink is equal to or less than 1.3 [m], the average particle size thereof is substantially the same as the 50% particle size, and the 90% particle size is double or less the 50% particle size, the average number of the printing omissions is reduced.

In a case of using the ink containing the aluminum pigments, it is difficult to pulverize the aluminum to be 0.4 [μm] or less. Accordingly, the average particles size of the ink pigment which can reduce the average number of the printing omissions is 0.4 [μm] to 1.3 [μm].

A case where the pigment of the used ink is spherical is considered. The factor which influences the printing omission is the largest dimension of the pigment and the particle long side in the aluminum pigment. As described above, in the aluminum pigment, the particle long side is about 5 times the particle size. On the other hand, in the spherical pigment, the particle long side and the particle size are the same. Accordingly, in the ink containing the spherical pigment, the average particle size of the ink pigment which can reduce the average number of the printing omissions is equal to or less than 6.5 [μm].

Figure 8:
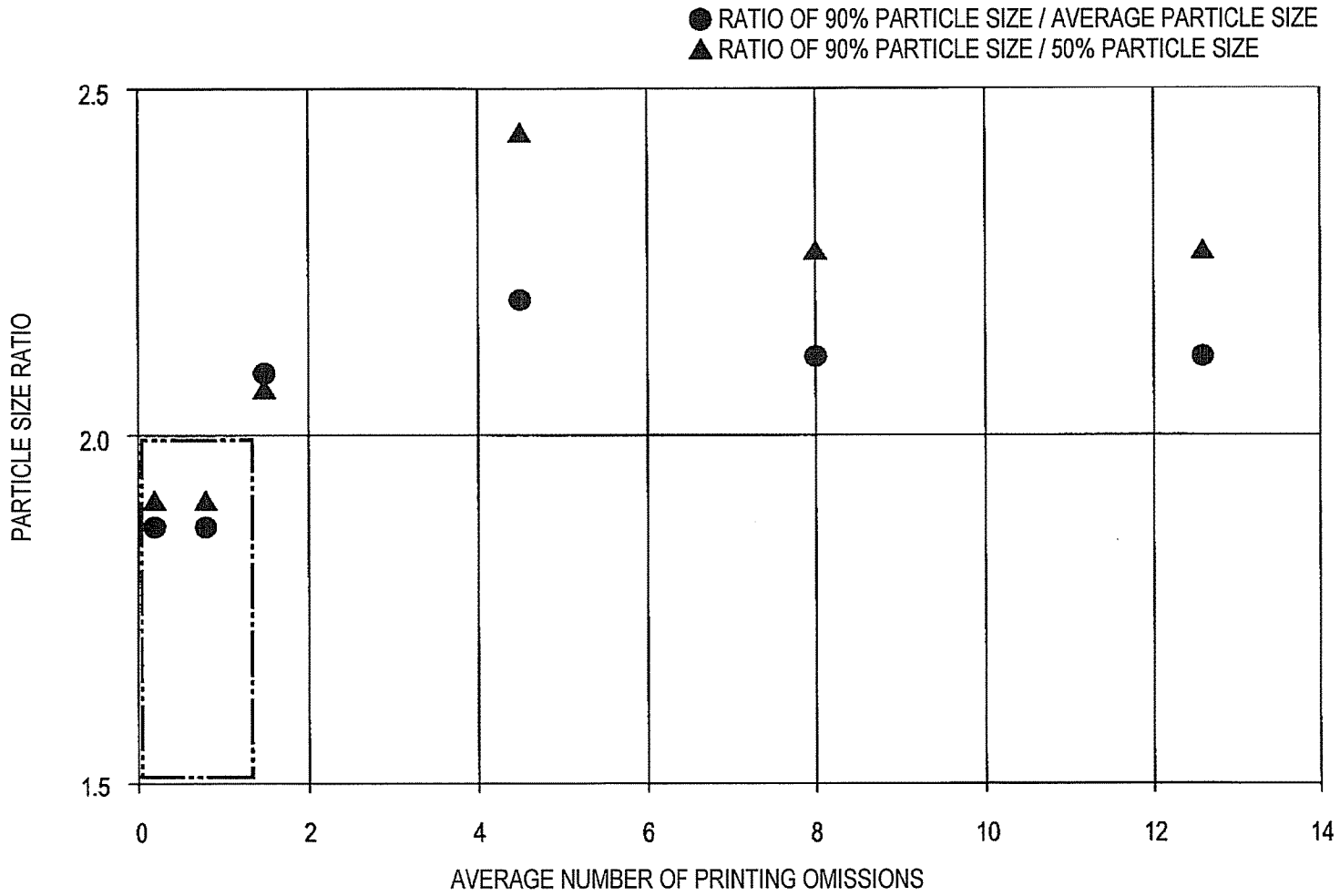
FIG. 8 is a graph showing a relationship between a diameter ratio of a particle of the ink of the exemplary embodiment and printing omission.

FIG. 8 is a scatter diagram showing a relationship between the particle size ratio of the ink pigment and the printing omission. Table 2 shows conditions of the ink pigment in the experiment of the scatter diagram of the FIG. 8. In the experience of FIG. 8 and Table 2, the printing omission when plural levels of voltage are applied to the actuator 44 is measured and averaged. The plural levels of voltage are voltage in five levels such as voltage (predetermined voltage) for discharging the ink of 42 [pl], voltage obtained by adding ±2 [V] to the predetermined voltage, and voltage obtained by adding ±1 [V] to the predetermined voltage.

In FIG. 8 and Table 2, 90% particle size, 50% particle size, and 10% particle size represent particle size of pigments in 90% integrated value, 50% integrated value, and 10% integrated value, respectively. The dimension of the ink pigment of Table 2 is measured by the laser diffraction type particle distribution measurement.

In Table 2, the Ink No. D is Second Example of the used ink shown in FIG. 5.

TABLE 2

| | Ink No. | | | | | | | |
|---|---|---|---|---|---|---|---|---|
| | A | B | C | D | E | F | G | H |
| Average particle size [μm] | 0.886 | 0.886 | 0.886 | 0.596 | 0.512 | 0.784 | 0.784 | 0.920 |
| Average particle long side [μm] | 4.430 | 4.430 | 4.430 | 2.980 | 2.560 | 3.920 | 3.920 | 4.600 |
| 90% particle size [μm] | 1.655 | 1.655 | 1.655 | 1.113 | 1.125 | 1.656 | 1.656 | 1.922 |
| 50% particle size [μm] | 0.867 | 0.867 | 0.867 | 0.582 | 0.461 | 0.729 | 0.729 | 0.928 |
| 10% particle size [μm] | 0.485 | 0.485 | 0.485 | 0.331 | 0.273 | 0.412 | 0.412 | 0.436 |
| Average number of printing omissions | 0.2 | 0.2 | 0.8 | 0.2 | 4.5 | 8.0 | 12.6 | 1.5 |
| Ratio of 90% particle size/50% particle size | 1.9 | 1.9 | 1.9 | 1.9 | 2.4 | 2.3 | 2.3 | 2.1 |
| Ratio of 90% particle size/average particle long side | 1.9 | 1.9 | 1.9 | 1.9 | 2.2 | 2.1 | 2.1 | 2.1 |

As shown in Table 2, in the experience of FIG. 8 and Table 2, the average particle sizes of the ink of Ink Nos. A to H are equal to or less than 1.3 [μm]. In addition, the average particle sizes of the ink of the Ink Nos. A to H are substantially same as the 50% particle size. As shown in FIG. 8, when the ratio of the 90% particle size and the 50% particle size is larger than 2.0, the average number of the printing omissions is increased. As shown in FIG. 8 and Table 2, when the average particle size of the pigments of the used ink is equal to or less than 1.3 [μm], the average particle size thereof is substantially the same as the 50% particle size, and the 90% particle size is double or less the 50% particle size, the average number of the printing omissions is reduced. In FIG. 8, a range where the number of the printing omissions is acceptable is surrounded with a dashed-two dotted line.

According to the ink jet printer 10 of the exemplary embodiment, the ink having a relatively large particle size of the pigment can be discharged. That is, in the ink jet printer 10 of the exemplary embodiment, the ink containing the pigment having the average particle size of 0.4 [μm] to 1.3 [μm] can be used while suppressing the printing omission. In a case of spherical ink pigment, the average particle size which can suppress the printing omission is from 0.4 [μm] to 6.5 [μm].

In the ink containing the aluminum pigment, as the particle size of the pigment gets larger, gloss of a printed image becomes excellent. Without limiting to the aluminum pigment, the same effects are applied as long as it is a pigment having gloss such as metal.

If the particle size of the pigment is large, the printing omission may occur even with no mixed bubbles and the like. However, as shown in the exemplary embodiment, it is possible to suppress the printing omission by using the ink containing the pigment in which the average particle size is equal to or less than 1.3 [μm], the average particle size thereof is substantially the same as the 50% particle size, and the 90% particle size is double or less the 50% particle size.

In addition, in the ink jet printer 10 of the exemplary embodiment, the ink having a relatively small particle size can be used. Accordingly, the ink j et printer 10 can correspond to various types of ink.

According to at least one of the ink jet recording apparatus and the recording method described above, the ink in which the average particle size in laser diffraction type particle distribution measurement is from 0.4 μm to 6.5 μm, the average particle size is substantially the same as the particle size in 50% integrated value, and the particle size in 90% integrated value is double or less the particle size in 50% integrated value, is used in a circulating-type ink jet recording apparatus. Accordingly, the ink containing pigment having a large size, can be used while suppressing the printing omission.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink jet recording apparatus for printing an image using a pigment ink in which a pigment is contained and which an average particle size of the pigment measured by laser diffraction type particle distribution measurement is from 0.4 μm to 6.5 μm, a difference between the average particle size and a particle size of the pigment in 50% integrated value is within a range of ±5%, and a particle size of the pigment in 90% integrated value is double or less the particle size in 50% integrated value, comprising:

an actuator which is formed by a piezoelectric material and includes a plurality of side walls and grooves each of which is formed between two of the adjacent walls and functions as a pressure chamber that accommodates the pigment ink and which changes volume of the pressure chamber;

an ink tank which accommodates the pigment ink;

a nozzle plate which includes a nozzle opening to the pressure chamber and having a diameter of 20 μm to 40 μm which is sized such that a ratio of the particle size in 50% integrated value to the diameter of the nozzle is from 0.01 to 0.325;

an ink supply unit which supplies the pigment ink to the pressure chamber;

an ink supply path which includes an end connected to the ink tank and an end connected to the ink supply unit;

a discharging unit which collects the pigment ink from the pressure chamber;

an ink collecting path which includes an end connected to the ink tank and an end connected to the discharging unit; and a circulating unit which includes a pump disposed on a circulating path and circulates the pigment ink in the circulation path, the circulation path including the ink tank, the ink supply path, the ink collecting path, the ink supply unit, the pressure chamber, and the discharging unit.

2. The apparatus according to claim 1, wherein the pump is disposed on the ink collecting path.

3. The apparatus according to claim 1, wherein standard deviation for a particle size distribution of the pigment is equal to or less than 0.21 μm.

4. The apparatus according to claim 1, wherein the ink tank is detachable.

5. An ink jet recording apparatus for printing an image using a pigment ink in which a pigment is contained and which an average particle size of the pigment measured by laser diffraction type particle distribution measurement is from 0.4 μm to 6.5 μm, a difference between the average particle size and a particle size of the pigment in 50% integrated value is within a range of ±5%, and standard deviation for a particle size distribution of the pigment is equal to or less than 0.21 μm, comprising:

an actuator which is formed by a piezoelectric material and includes a plurality of side walls and grooves each of which is formed between two of the adjacent walls and functions as a pressure chamber that accommodates the pigment ink and which changes volume of the pressure chamber;

an ink tank which accommodates the pigment ink;

a nozzle plate which includes a nozzle opening to the pressure chamber and having a diameter of 20 μm to 40 μm which is sized such that a ratio of the particle size in 50% integrated value to the diameter of the nozzle is from 0.01 to 0.325;

an ink supply unit which supplies the pigment ink to the pressure chamber;

an ink supply path which includes an end connected to the ink tank and an end connected to the ink supply unit;

a discharging unit which collects the pigment ink from the pressure chamber;

an ink collecting path which includes an end connected to the ink tank and an end connected to the discharging unit; and a circulating unit which includes a pump disposed on a circulating path and circulates the pigment ink in the circulation path, the circulation path including the ink tank, the ink supply path, the ink collecting path, the ink supply unit, the pressure chamber, and the discharging unit.

6. The apparatus according to claim 5, wherein the pump is disposed on the ink collecting path.

7. The apparatus according to claim 5, wherein the ink tank is detachable.

8. An ink jet recording apparatus for printing an image using a pigment ink in which a pigment is formed non-spherical and which an average particle size of the pigment in laser diffraction type particle distribution measurement is from 0.4 μm to 1.3 μm, a difference between the average particle size and a particle size of the pigment in 50% integrated value is within a range of ±5%, and a particle size of the pigment in 90% integrated value is double or less the particle size in 50% integrated value, comprising:

an actuator which is formed by a piezoelectric material and includes a plurality of side walls and grooves each of which is formed between two of the adjacent walls and functions as a pressure chamber that accommodates the pigment ink and which changes volume of the pressure chamber;

an ink tank which accommodates the pigment ink;

a nozzle plate which includes a nozzle opening to the pressure chamber and having a diameter of 20 μm to 40 μm which is sized such that a ratio of the particle size in 50% integrated value to the diameter of the nozzle is from 0.01 to 0.325;

an ink supply unit which supplies the pigment ink to the pressure chamber;

an ink supply path which includes an end connected to the ink tank and an end connected to the ink supply unit;

a discharging unit which collects the pigment ink from the pressure chamber;

an ink collecting path which includes an end connected to the ink tank and an end connected to the discharging unit; and a circulating unit which includes a pump disposed on a circulating path and circulates the pigment ink in the circulation path, the circulation path including the ink tank, the ink supply path, the ink collecting path, the ink supply unit, the pressure chamber, and the discharging unit.

9. The apparatus according to claim 8, wherein the pump is disposed on the ink collecting path.

10. The apparatus according to claim 8, wherein a pigment shape of the ink is a scale shape.

11. The apparatus according to claim 10, wherein the pigment has a shape with a thickness of 20 nm to 100 nm, a short side length of 0.5 μm to 3 μm, and a long side length that is 1 to 5 times the average particle size.

12. The apparatus according to claim 11, wherein the ink contains a scale-shaped aluminum pigment.

13. The apparatus according to claim 8, wherein standard deviation for a particle size distribution of the pigment is equal to or less than 0.21 μm.

14. The apparatus according to claim 8, wherein the ink tank is detachable.

* * * * *